US012240508B2

(12) United States Patent
Buschbeck et al.

(10) Patent No.: US 12,240,508 B2
(45) Date of Patent: Mar. 4, 2025

(54) ACTUATOR-OPERABLE DRIVING SETTINGS DEVICE FOR A RAIL VEHICLE

(71) Applicant: Bombardier Transportation GmbH, Berlin (DE)

(72) Inventors: Jan Buschbeck, Berlin (DE); Marc Zechel, Berlin (DE)

(73) Assignee: Bombardier Transportation GmbH, Berlin (DE)

( * ) Notice: Subject to any disclaimer, the term of this patent is extended or adjusted under 35 U.S.C. 154(b) by 148 days.

(21) Appl. No.: 18/021,977

(22) PCT Filed: Aug. 5, 2021

(86) PCT No.: PCT/EP2021/071940
§ 371 (c)(1),
(2) Date: Feb. 17, 2023

(87) PCT Pub. No.: WO2022/037966
PCT Pub. Date: Feb. 24, 2022

(65) Prior Publication Data

US 2023/0356758 A1 Nov. 9, 2023

(30) Foreign Application Priority Data

Aug. 19, 2020 (DE) ..... 10 2020 210 544.8

(51) Int. Cl.
*B61L 15/00* (2006.01)
*B61L 27/04* (2006.01)

(52) U.S. Cl.
CPC ..... *B61L 15/0063* (2013.01); *B61L 15/0072* (2013.01); *B61L 27/04* (2013.01)

(58) Field of Classification Search
CPC ... B61L 15/0063; B61L 15/0072; B61L 27/04
See application file for complete search history.

(56) References Cited

U.S. PATENT DOCUMENTS

| | | | | |
|---|---|---|---|---|
| 9,266,542 | B2 | 2/2016 | Daum et al. | |
| 10,093,326 | B2 * | 10/2018 | Glinka | B61C 3/00 |
| 11,401,691 | B2 * | 8/2022 | Westergaard | E02F 3/432 |
| 2016/0332648 | A1 * | 11/2016 | Yu | B61L 27/04 |
| 2017/0210399 | A1 | 7/2017 | Leonard et al. | |
| 2017/0253257 | A1 * | 9/2017 | Loskarn | G05B 19/0423 |
| 2020/0156681 | A1 * | 5/2020 | Bienek | B61L 15/0058 |
| 2021/0171068 | A1 | 6/2021 | Zenk | |
| 2022/0032983 | A1 * | 2/2022 | Angierski | B61L 27/04 |

FOREIGN PATENT DOCUMENTS

| | | | |
|---|---|---|---|
| DE | 102007047178 | A1 | 4/2008 |
| DE | 102017123766 | A1 | 4/2019 |
| DE | 102018210926 | A1 | 1/2020 |
| DE | 102019104347 | A1 | 8/2020 |

* cited by examiner

*Primary Examiner* — Mohamed Barakat
(74) *Attorney, Agent, or Firm* — The Webb Law Firm

(57) ABSTRACT

A driver's cab configuration for a rail vehicle includes a driving settings device operable by a vehicle driver for setting a desired driving behaviour of the rail vehicle, and a memory device in which a target driving behaviour profile for the rail vehicle is stored. The driver's cab configuration includes an operating actuator which is configured to operate the driving settings device based on the target driving behaviour profile, and a drive control device which is configured to control at least a drive device of the rail vehicle based on operations the driving settings device.
A method for operating a rail vehicle is also disclosed.

9 Claims, 1 Drawing Sheet

ACTUATOR-OPERABLE DRIVING SETTINGS DEVICE FOR A RAIL VEHICLE

CROSS REFERENCE TO RELATED APPLICATIONS

This application is the United States national phase of International Patent Application No. PCT/EP2021/071940 filed Aug. 5, 2021, and claims priority to German Patent Application No. 10 2020 210 544.8 filed Aug. 19, 2020, the disclosures of which are hereby incorporated by reference in their entireties.

BACKGROUND OF THE INVENTION

Field of the Invention

The invention relates to a driver's cab configuration for a rail vehicle as well as a method for operating a rail vehicle. Particularly, the rail vehicle may be a locomotive, a railcar, or a combination of a plurality of individual rail vehicles.

Description of Related Art

It is known that the vehicle driver (or also train driver) of a rail vehicle can set a desired driving behaviour of the rail vehicle by means of a driving settings device. This may be a manually operable element (particularly of a mechanical type) in a driver's cab of the rail vehicle. Known examples are driving settings devices in the form of movable levers, particularly so-called drive-brake levers. These can be manually displaced along a scale by shifting or tilting. The degree of the adjustment is sensor-detected. A driving behaviour, and particularly a value of a specifically determinable driving behaviour parameter (particularly a driving speed, a traction force, and/or an acceleration) is allocated to each position of the driving settings device. From a sensor-detected position of the driving settings device, therefore, the desired driving behaviour parameter set by the driver (also referred to as the vehicle driver here) can be determined, and a drive device (particularly a traction motor) of the rail vehicle can be controlled to provide or implement this driving behaviour parameter.

It is further known to support a vehicle driver in controlling the rail vehicle so that he/she will implement a desired driving behaviour. For example, route-dependent target driving behaviour profiles may be determined, particularly in the form of so-called route-speed profiles or diagrams. These may define speeds for individual route segments which are particularly suitable for achieving a desired efficiency or reduced power consumption. The target driving behaviour profile, and particularly appropriate speeds defined thereby may be displayed, particularly visually, to a vehicle driver in the driver's cab. In this way, he/she is to be motivated to implement the target driving behaviour by appropriate operations of the driving settings device. In other words, the vehicle driver is to observe the driving behaviour predetermined by the target driving behaviour profile and to manually control the rail vehicle in conformity with this profile.

However, it has become apparent that an associated implementation by the vehicle driver will not always succeed. For example, he/she may potentially only respond to changes in the predetermined target driving behaviour with a delay when he/she does not notice them in time. This affects the actually achieved efficiency in the operation of the rail vehicle.

Furthermore, it is also known to autonomously control rail vehicles and particularly their driving speed. In this way, manual delays in the realisation of a desired target driving behaviour can be avoided. However, the approval requirements of the respectively competent authorities to be met for this purpose are high and can in parts only be fulfilled with high and cost-intense technical effort. Particularly, extensive technical measures on the rail traffic route for monitoring the autonomous driving operation will then also be required in most cases.

SUMMARY OF THE INVENTION

It is therefore an object of the invention to improve the implementation of a desired target driving behaviour by a rail vehicle. Particularly, this implementation is to succeed more precisely while involving limited technical effort.

Generally, the invention provides for the provision of a driving settings device in a driver's cab configuration which, apart from being manually operable (particularly adjustable), may also be actuator-operable. Here, the actuator operation or adjustment is performed based on a target driving behaviour profile. The target driving behaviour profile may correspond to the known target profiles mentioned in the introduction and particularly be a route-speed profile. However, instead of implementing this in a fully autonomous manner or of visually displaying it to a driver for an exclusively manual implementation, in the present case, it is contemplated to actively operate, particularly to deflect a preferably conventional driving settings device by means of a separate operating actuator based on this target driving behaviour profile.

In other words, the operating actuator preferably operates the driving settings device so that it assumes a position which is required for achieving a driving behaviour predetermined by the target driving behaviour profile. For example, if this profile defines a target speed, preferably depending on a location, the driving settings device may be actuator-operated so that its state and particularly its position corresponds to this target speed, or this target speed is set thereby without a manual operation when the associated location is reached.

Preferably, an operating state of the driving settings device is detected in accordance with conventional approaches and/or analogous to a manual operation here. Particularly, a drive device of the rail vehicle is controlled based on the operating state and particularly a position the driving settings device to implement the driving behaviour set by the driving settings device.

This also means that only minor or even no adaptations of existing control architectures of rail vehicles are required. From the perspective of the control, preferably, it makes no difference whether the driving settings device is actuator or manually operated, i.e., driving systems of the rail vehicle can be controlled independent of the type of operation of the driving settings device, and, for example, based exclusively on their movement and/or position. In this way, the approval requirements are considerably reduced since already approved controls or control architectures can be relied on. Preferably, no autonomous activations or a deactivation of an operating mode in which the driving settings device is actuator-adjusted are possible either which further reduces the requirements for approval.

From the perspective of the vehicle driver, a realisation of the target driving behaviour profile is reliably ensured since, in this way, the driving settings device is moved into an appropriate position or an appropriate operating state for implementing this profile by means of an actuator in conformity with this profile. This prevents delays in an implementation of the target driving behaviour profile which might occur in case of an exclusively manual operation. On the other hand, the vehicle driver will receive direct visual feedback by the actuator operation of the driving settings device. Particularly, the driving settings device may be tilted, rotated or pivoted by means of an actuator which the vehicle driver can notice and realise accordingly. This corresponds to an intuitive feedback to the vehicle driver. This increases the operational safety of the rail vehicle since the vehicle driver can always distinctly identify a set driving state of the rail vehicle.

Furthermore, however, the vehicle driver can, directly and in a targeted manner, change the operating state of the rail vehicle and, in particular, precisely adapt its driving behaviour by manual intervention and particularly by a manual adjustment of the driving settings device. This particularly applies because an actuator-adjusted current position of the driving settings device corresponds to an actually set driving behaviour. A change of the driving behaviour desired on the part of the vehicle driver is therefore intuitively realisable by a manual operation of the driving settings device.

This solution renders a kind of partially autonomous operation of the rail vehicle and particularly of the driving settings device possible. Even in case of an autonomous change of the driving state by an actuator-induced adjustment of the driving settings device, preferably, manual change and intervention options will always exist. In addition, an operating mode in which the driving settings device is adjustable by means of an actuator may be (preferably exclusively) manually activatable and/or deactivatable. Particularly, there are no driver-autonomous activations of the actuator adjustment so that, for example, the vehicle cannot accelerate unexpectedly in a driver-autonomous manner (for example without a previous manual release or activation). In this way, approval requirements can be reduced as compared to a fully autonomous operation of the rail vehicle.

In summary, therefore, the introduced solution renders a precise implementation of a desired target driving behaviour possible which is characterised by safe and intuitive manual intervention options as well as by low approval requirements. Furthermore, the solution is characterised by low adaptation efforts with respect to existing rail vehicles and particularly their control architectures.

In particular, a driver's cab configuration for a rail vehicle is proposed, the driver's cab configuration comprising:

- a driving settings device (e.g. a lever or a rotary wheel) which is (manually) operable by a vehicle driver for setting a desired driving behaviour of the rail vehicle;
- a (digital and/or electronic) memory device in which a target driving behaviour profile for the rail vehicle is stored;
- an operating actuator (also merely referred to as an actuator here) which is configured to operate the driving settings device based on the target driving behaviour profile, particularly independent of the vehicle driver; and
- a drive control device which is configured to control at least a drive device of the rail vehicle in conformity with operations of the driving settings device.

The memory device may be part of a control means of the rail vehicle. Preferably, however, the drive control device does not directly access the memory device or at least the target driving behaviour profile. Particularly, the drive control device preferably does not control the drive device of the rail vehicle directly on the basis of the target driving behaviour profile, for example, not by reading or otherwise processing information of the target driving behaviour profile. Instead, as it is also the case in current manual operations of driving settings device, it preferably reads operations of the driving settings device implemented by the operating actuator or controls the drive devices based on associated operations of the driving settings device. Here, from the perspective of the drive control device, it is preferably irrelevant whether an operation of the driving settings device was manually or actuator induced. In other words, the drive control device may use any operation of the driving settings device to control the drive control device based thereon, irrespective of the (actuator or manual) source or origin of the operation.

As mentioned above, this is advantageous in that few components of the rail vehicle have to be changed which particularly facilitates retrofitting the present solution in existing rail vehicles or reduces the development effort starting from already existing rail vehicles. Particularly, the driving settings device and the drive control device may be designed in accordance with conventional approaches. This is also helpful with regard to the operational safety and the associated approval requirements since the drive control device can control the drive devices of the rail vehicle in a conventional manner on the basis of detected operations of the driving settings device. If the drive control device, as not preferable here, would directly receive the target driving behaviour profile instead and control drive devices of the rail vehicle based thereon new safety risks would be created, and an existing software or control architecture of a rail vehicle would have to be revised.

The target driving behaviour profile may specify at least one progress of a desired driving behaviour parameter, e.g. with respect to a defined route. The previous development of such driving behaviour profiles is known, e.g., based on simulations or measurement rides. They can be stored in a memory device of the rail vehicle as digital files and, e.g., in the form of characteristics, tables or generally as collections of data or data bases. They may also be stored in the memory device by temporary storage and/or a download from a vehicle-external computer device (particularly a server, and more particularly an Internet server).

The rail vehicle may be configured to determine its location to which end common solutions according to prior art may be used. It may be further designed to determine a target driving behaviour parameter defined by the target driving behaviour profile based on the detected location. This will be explained in more detail below.

For controlling the drive device of the rail vehicle which may particularly be an electric drive motor or an engine and which can be generally referred to as a traction motor, the drive control device may adjust, for example, an (electric) power supply to the drive device. In other words, the drive control device may particularly control the power electronics of the drive device (if it comprises an electric motor) for implementing a desired driving behaviour.

Forces producible by the operating actuator may be selected so that they can be manually overcome, i.e., overridden by a vehicle driver. In other words, they may be limited so that a vehicle driver can equalise or even overcome an operation performed by the operating actuator by an oppositely directed operation. In case of such an override, also, a partially autonomous operation explained below and/or the operating actuator may be automatically deactivated.

As explained below, when manual forces are applied to the driving settings device, the operating actuator may also be mechanically decoupled from it, at least when the manual forces exceed a threshold value. This may be achieved by a safety coupling connecting the operating actuator to the driving settings device which, at corresponding forces, opens and releases an initially force- and/or torque-transmitting connection.

Advantageously, for activating an actuator operation of the driving settings device, an activation or closing of such a safety coupling is required. In this way, it can be ensured that a vehicle driver has to deliberately activate or enable actuator operations. Closing the safety coupling may, for example, take place electronically and be activated by an operation of an operating element (for example of a push button) by the vehicle driver. On principle, also mechanical activations are possible. For this purpose, for example, a control element mechanically coupled to the coupling may protrude into the vehicle interior and be adjustable by the vehicle driver.

Owing to the manual intervention options and particularly the activation options, it is ensured that the vehicle driver can always interrupt or adapt a driver-autonomous operation of the rail vehicle.

The operating actuator may comprise at least one electric motor and/or be an electric actuator. It may be mechanically connected to the driving settings device, for example, via at least one connecting arrangement. The connecting arrangement may, for example, comprise a belt drive or a gear stage. Generally, it preferably comprises the safety coupling already mentioned.

The actuator may be designed to move the connecting arrangement and to thereby operate the driving settings device. For example, the operating actuator may be designed to tilt or to deflect the driving settings device, particularly in the form of a lever, through the connecting arrangement.

For example, the driving settings device may comprise or be coupled to a rotary axis element. The rotary axis element may be rotatably supported. The connecting arrangement may couple the rotary axis element to the operating actuator, for example in a force- and/or moment-transmitting manner.

According to a preferred further development, the drive control device is designed to control the drive device irrespective of whether the driving settings device is operated by the vehicle driver or by the operating actuator. As mentioned above, the drive control device may have no information about an origin or source of the operation of the driving settings device, and, essentially, it cannot be determined either.

To this end, the drive control device may only receive signals relating to a performed operation of the driving settings device, not, however, to, e.g., a current operating state of the actuator or a generally set manual or partially autonomous operating mode. At least it cannot analyse or use such information to determine a cause of the operation of the driving settings device. Instead, the drive control device may control the drive device in the same way and exclusively based on the degree or the type of the operation irrespective of whether an operation was performed manually or by means of an actuator. In this way as well, it is guaranteed that no fundamental changes on existing control architectures of a rail vehicle are required but that, particularly, a drive control device can control drive devices of the rail vehicle in the conventional way based on detected operations of a driving settings device.

A further embodiment provides that the driver's cab configuration comprises an operation detection means which is configured to detect operations and/or states (particularly positions) of the driving settings device and to transmit them to the drive control device. It may be a sensory system or, in brief, a sensor. It may be configured according to a conventional design. It may be designed to detect a current type of operation and particularly a degree of the operation, for example a current position of the driving settings device. In this way, for example, it can be detected to which degree a lever-like driving settings device is tilted or a driving settings device in the form of a rotary wheel was rotated. The operation detection means may comprise a measuring body which is movable and particularly tiltable together with the driving settings device. It may further comprise a sensory unit which is designed to detect a current position of the measuring body. The sensory unit is preferably statically installed. The reverse case of a sensory unit moving together with the driving settings device while the measuring body is stationary is also possible.

In summary, the measuring body and the sensory unit may be generally movable relative to each other, one among the measuring body and the sensory unit preferably being movable together with the driving settings device. For example, one of the measuring body and the sensory unit may be coupled to a rotary axis element of the type explained above.

On principle, detected operations or states may be transmittable to the drive control device, preferably by the control means itself, or also by another control means or a communication system of the rail vehicle.

A further development provides that the operation of the driving settings device comprises adjusting or also moving the driving settings device. Particularly, the operation may comprise tilting, shifting and/or rotating the driving settings device (about a horizontal, vertical or also inclined axis of rotation). This corresponds to common types of moving driving settings device which are perceived as intuitive by a vehicle driver and are reliably implementable by an operating actuator.

According to a preferred embodiment, at least one of the following driving behaviour parameters of the rail vehicle is determinable by means of the driving settings device:

a driving speed;

a traction force;

a positive acceleration;

a negative acceleration, i.e., a deceleration.

The target driving behaviour profile preferably defines values for an identical driving behaviour parameter or a driving behaviour parameter which is convertible into the driving behaviour parameter settable by the driving settings device.

As mentioned, according to a further aspect, the operating actuator may be connected to or, in other words, coupled or couplable to the driving settings device in a torque-transmitting manner through a safety coupling. This connection may be indirectly established via a connecting arrangement of the type described herein. The safety coupling may be connected to a rotary axis element of the driving settings device. In a per se known manner, the safety coupling may disengage, i.e. open, for example, when a maximally transmittable torque is exceeded. Preferably, such disengagement may occur when manual forces are applied to the driving settings device, these forces resulting in a torque effective on the safety coupling.

Accordingly, a further development provides that the safety coupling is openable as a result of the application of manual forces to the driving settings device. In this way, a possibility of deactivating actuator operations of the driving settings device or of manually overriding the operating actuator is provided which is reliable and mechanically realisable with low effort. In addition or as an alternative, opening can take place by means of the operating element described herein.

Preferably, closing and/or opening the safety coupling is manually activatable, for example by means of the abovementioned (electronic) operating element or a mechanical operating member. Particularly, closing and/or opening the safety coupling is preferably only manually activatable, i.e., the safety coupling cannot disengage and/or engage automatically or driver-autonomously. Otherwise, there would be the possibility of driver-autonomous activations and/or deactivations of the actuator operation and/or of a corresponding operating mode which might increase the approval requirements.

Particularly, it may be contemplated that the target driving behaviour profile defines a location-dependent target driving behaviour, particularly a location-dependent target driving speed. In other words, values for at least one driving behaviour parameter, particularly of the abovementioned type, may be defined and/or predetermined by the profile as an associated target driving behaviour depending on the location. The location-dependency may be established by the associated values relating to specific route segments of a route. As mentioned, the rail vehicle may be designed to determine its current location and/or a currently travelled-on route segment. The operating actuator (particularly its control means), informed of this location or route segment, may be designed to determine or to receive a current value of the driving behaviour parameter defined by target driving behaviour profile and to operate the driving settings device correspondingly.

In this connection, it may particularly be contemplated that the operating actuator is designed to operate (particularly to adjust or to move) the driving settings device so that the driving settings device assumes a position in or by which a driving behaviour corresponding to the target driving behaviour profile (particularly to a target driving behaviour parameter currently defined thereby) is settable. In other words, the operating actuator may be designed to adjust the driving settings device so that a (current) driving behaviour parameter defined by the target driving behaviour profile is determinable and/or implementable in this way. For this purpose, the operating actuator may have knowledge of the correlation of operations and/or positions of the driving settings device and therefore determinable driving behaviour parameters, for example due to calibration information.

A corresponding configuration of the operating actuator will ensure that it can precisely implement a target driving behaviour profile, and that an operation and particularly an adjustment of the driving settings device brought about thereby also corresponds to the actually predetermined driving behaviour profile. In this way, precise feedback to the vehicle driver is ensured.

According to a preferred aspect, the driver's cab configuration is operable in a manual operating mode. In it, the operating actuator preferably does not perform any operations of the driving settings device and/or is generally inactive. A potential safety coupling may be opened in this operating mode.

Further, the driver's cab configuration is preferably also operable in an at least partially autonomous operating mode and may preferably be switched between the manual and the partially autonomous operating mode. In it, the driving settings device may be operable by the operating actuator, i.e., the operating actuator may be generally active, and/or a safety coupling may be closed.

However, in addition, a manual operation of the operating actuator can preferably also be performed in the partially autonomous operating mode. This may include the abovementioned override of actuator operations of the driving settings device including the preferred disengagement of an optional safety coupling. Switching between the manual and the partially autonomous operating mode may (preferably exclusively) be induced by a vehicle driver, for example by him/her performing or inducing the closing of the safety coupling.

The invention further relates to a method for operating a rail vehicle, the rail vehicle comprising a driving settings device operable by a vehicle driver for setting a desired driving behaviour, the method comprising:

an actuator operation of the driving settings device based on a target driving behaviour profile, particularly independent of operations by the train driver; and controlling at least a drive device of the rail vehicle based on the operation of the driving settings device.

The method may comprise all other features and further developments for providing all functionalities, operating states and advantages of the driver's cab configuration described above. All explanations relating to and further developments of features of the driver's cab configuration may also apply to the identically formulated method features or be provided by these. Generally, the method can operate a driver's cab configuration according to any of the aforementioned aspects.

Particularly, the method may further comprise steps of detecting the operation of the driving settings device (for example by means of the operation detection means explained above). The drive control device may be controlled on the basis of this detected operation. Likewise, the method may comprise steps of detecting or receiving a target driving behaviour parameter currently predetermined by the target driving behaviour profile as well as the actuator operation of the driving settings device based thereon. The method may also comprise measures for selecting a manual operating mode or a partially autonomous operating mode or for switching between them.

BRIEF DESCRIPTION OF THE DRAWINGS

In the following, embodiments of the invention will be explained with reference to the appended schematic Figures. Features having the same effect or of the same kind may be designated by the same reference numerals across the Figures here.

DESCRIPTION OF THE INVENTION

Figure 1A:
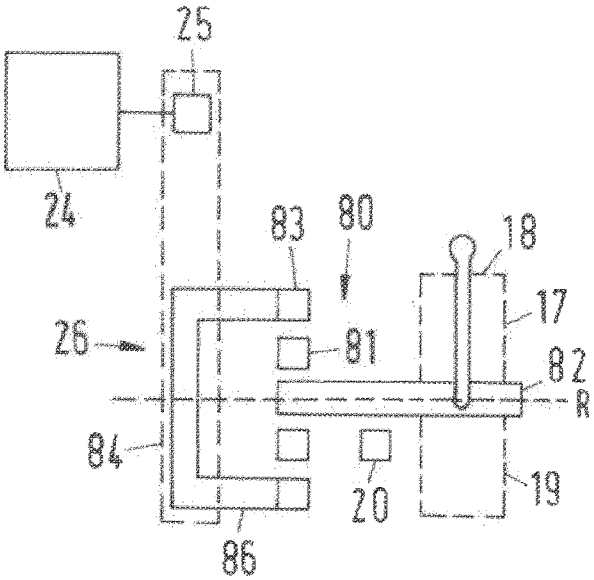
FIG. 1*a* shows a detailed view of the driver's cab configuration according to FIG. 1 in the area of a drive/brake lever.
Figure 1:
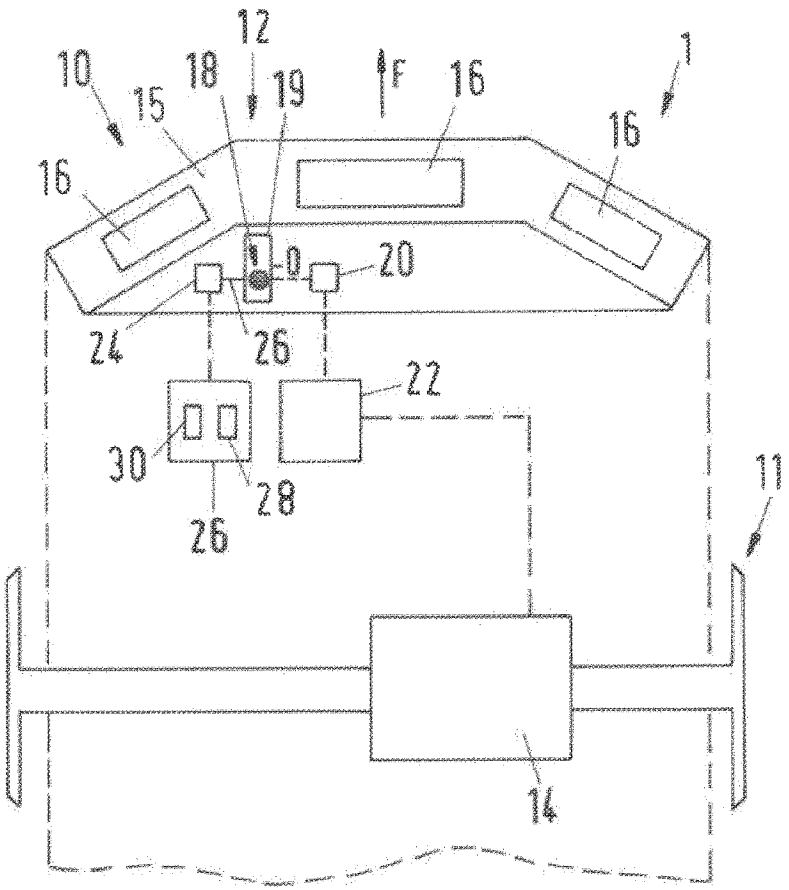
FIG. 1 shows a driver's cab configuration according to an embodiment of the invention which is operated based on a method according to an embodiment.

In FIG. 1, a schematically highly simplified view of a rail vehicle 1 is shown. More precisely, a plan view of the rail vehicle 1 and particularly its driver's cab 10 is shown. Essential constituent parts of the rail vehicle 1 such as, for example, the roof construction are omitted. An outer contour of the rail vehicle 1 is shown in dashed lines and not fully rendered here. As another constituent part of the rail vehicle, a wheel axle 11 driven by an electric traction motor is shown. The latter constitutes a drive device 14. A forward driving direction F of the rail vehicle 1 is indicated.

Apart from a conventional control console 15 including indicated monitors 16, the driver's cab 10 comprises a driver's cab configuration 12 according to an embodiment of the invention.

The driver's cab configuration 12 initially comprises a driving settings device in the form of a lever 18. It is shown in a plan view so that only its circular contour is visible. The lever 18 is movable in a slot 19. More precisely, it is operable so that it is shiftable or tiltable along the slot 19. Such a movement corresponds to an adjustment of the lever 18. Further details of the lever 18 can be gathered from FIG. 1*a* discussed below.

Assumed positions of the lever 18 (i.e., its current operating state or degree of operation) are detectable by means of an operation detection means 20. As indicated in dashed lines, it is connected to a drive control device 22 in the form of a control device comprising the at least one processor means not separately shown in a data-transmitting manner. In this way, operations detected by the operation detection means 20 and particularly current positions of the lever 18 are transmitted to the drive control device 22.

By way of example, a zero position of the lever 18 along the moving slot 19 designated by 0 is shown. When the lever 18 assumes this position a driving speed of 0 km/h is set by it. Shifts in the forward driving direction F correspond to the setting of an increasing positive driving speed, a specific predetermined driving speed value being allocated to each corresponding position of the lever 18. Shifts opposite to the forward driving direction F correspond to the setting of a deceleration or a negative acceleration.

Based on the position of the lever 18 detected by the operation detection means 20, the operation detection means 20 or the drive control device 22 can determine a driving behaviour currently set by the lever 18, and more precisely, a driving behaviour parameter in the form of the driving speed and/or a potential negative acceleration currently set thereby. In a per se known manner, the drive control device 22 is designed to control the drive device or the traction motor 14 based thereon, for example via a data connection indicated in dashed lines, so that it implements the predetermined driving behaviour parameter by appropriately driving the wheel axle 11.

The driver's cab configuration 12 according to the shown embodiment also comprises an operating actuator 24. In the case shown, it is an electric motor. It is mechanically coupled to the lever 18 via a schematically indicated connecting arrangement 26. More precisely, coupling is performed so that the operating actuator 24, in the following also only referred to as the actuator or motor, can move or adjust the lever 18 along the slot 19 by force and/or momentum transmission by the connecting arrangement 26. The connecting arrangement 26 is only optional, and a direct mechanical coupling of the actuator 24 and the lever 18 could also be provided. As yet to be discussed with reference to FIG. 1*a*, however, preferably a safety coupling 80 is provided to selectively and mechanically couple or disengage the actuator 24 and the lever 18 to or from each other.

As indicated in dashed lines, the actuator 24 is connected to an actuator control system 26 in a data-transmitting manner. It comprises at least one processor means 28. In addition or as an alternative, at least one memory device 30 is provided. In the memory device 30, a target driving behaviour profile is stored, for example in the form of a characteristic, of a general data set, or of a data table. Said storage may be performed on the part of a vehicle manufacturer, subsequently, e.g. within the scope of development works or software updates, or in the preparation of a particular driving operation, for example by downloading the target driving behaviour profile from a vehicle-external computer system (for example by means of a mobile radio or Internet connection).

The actuator control system 26 is generally designed to control the operating actuator 24 so that it moves or adjusts the lever 18 in a desired manner. For this purpose, the rail vehicle 1 (for example a separate control means not shown or else the actuator control system 26 itself) initially determines a current location of the rail vehicle 1 or a route segment currently travelled on by it. Then, a driving behaviour parameter predetermined by the target driving behaviour profile (in the shown exemplary case the driving speed) for this location or for this route segment is determined. This may also be performed by the actuator control system 26 and particularly its processor means 28.

A correlation between a position to be assumed by the lever 18 so that, in this way, the associated determined driving behaviour parameter is settable or that it assumes a position along of the slot 19 which corresponds to an associated magnitude specification may also be stored in advance (particularly in the memory device 30). Such a correlation may be determined, e.g., by way of calculation or calibration. In this way, the actuator control system 26 is informed of which position the lever 18 is to assume for setting the driving behaviour parameter currently desired according to the target driving behaviour profile and can control the operating actuator 24 correspondingly. For the sake of completeness, it is to be understood that the correlation between an actuator operation and a position of the lever 18 realisable or attainable thereby may also be known and, e.g., determined in advance.

In FIG. 1*a*, a detailed view of the area of the lever 18 is shown. The view, in turn, corresponds to a plan view analogous to FIG. 1, components hidden by the control console 15 from the perspective of the vehicle driver being nonetheless partly illustrated for explanatory reasons.

The illustration is schematic again and may therefore, in details, deviate from the positioning of individual components shown in FIG. 1.

Again, the lever 18 as well as the slot 19 indicated in dashed lines can be seen. The lever 18 is moved or tilted into a position directed forwards. For this purpose, the lever 18 comprises a rod 17 by means of which it is connected to a rotary axis element 82. The rotary axis element 82 is movably supported by rotary bearings not specifically shown. The axis of rotation R extends in the sheet plane and along the rotary axis element 82 here. Correspondingly, it becomes clear that, depending on a movement or tilt of the lever 18, the rotary axis element 82 is rotatable about the axis of rotation R.

Also indicated is a position of the operation detection means 20 which may be generally implemented as a sensor for detecting a rotational movement and/or an angular position of the rotary axis element 82.

It is not specifically shown that the rotary axis element 82 may optionally also be detected by other sensory units in a per se known manner. This is applied in common control architectures to retrieve so-called safety signals. However, since, in the present case, the rotary axis element 82 remains substantially unchanged as compared to existing solutions these safety signals can still be retrieved, and therefore the control architecture of the rail vehicle 1 can remain substantially unchanged.

By way of example, a safety coupling 80 is shown on one end of the rotary axis element 82. It may be configured according to known solutions. In a schematically highly simplified manner, it is indicated that a first, by way of example ring-shaped member 81 of the safety coupling 80 is coupled with the rotary axis element 82 in a rotationally fixed manner. A second, by way of example ring-shaped member 83 is connected to the connecting arrangement 26 in a rotationally fixed manner. The members 81, 83 are connectable in a torque-transmitting manner (engaged state) or detachable from each other (disengaged state without torque transmission) via a coupling mechanism not specifically shown.

It is not specifically shown that the coupling mechanism or generally the safety coupling 80 is electronically operable, the operation being manually performable by the vehicle driver by way of an operating element on the driver's console 15 which is not specifically shown. The safety coupling 80 may also be understood to be a constituent part of the connecting arrangement 26.

By way of example, the connecting arrangement 26 comprises a first belt pulley 86 which is illustrated in cross section and may optionally be formed as a hollow cylinder (shown with an optionally closed bottom here) around the axis of rotation R. The belt pulley 86 is connected to the second member 83 of the safety coupling 80 in a rotationally fixed manner. The belt pulley 86 is connected to a drive pulley 25 of the actuator 24 also serving as a belt pulley by a belt 84 indicated in dashed lines. The belt 84 extends around the belt pulley 86 and the drive pulley 25 so that, in the plan view of FIG. 1, only a segment or only about half of the length of the belt 84 (particularly only its top circumferential segment) is visible. Another segment or another half is hidden by the segment shown. In other words, the axis of rotation R is enclosed by the belt 84, or the belt 84 extends around the axis of rotation R by being wound around the belt pulley 86 and the drive pulley 25.

When the safety coupling 80 is closed a torque can be transmitted to the rotary axis element 82 by the actuator 24 by means of the connecting arrangement 26, and the lever 18 can then be tilted within the slot 19. This is detected by the operation detection means 20. If the vehicle driver (even with the lever 18 standing still) will now manually apply a force to the lever 18 and thus a moment to the rotary axis element 82, the safety coupling 80 will open when a threshold torque is exceeded. Then, the operating actuator 24 can no longer transmit moments to the rotary axis element 82 and, consequently, not operate the lever 18. Consequently, a manual operating mode is given which was activated by the manually induced opening of the safety coupling 80.

The renewed closing of the safety coupling 80 is preferably only performed in response to a corresponding request of the vehicle driver, for example by operating the operating element not shown. This enables switching into a partially autonomous operating mode.

As a general aspect of the disclosed solution not limited to the embodiment and the details shown there, the safety coupling 80 is therefore preferably positioned between the operating actuator 24 and an element detected by the operation detection means 20 (by way of example here: the rotary axis element 82). This positioning may particularly relate to a position in the flow of forces between the actuator 24 and the lever 18. This renders a reliable detectability of lever operations possible even with the safety coupling 80 opened.

In summary therefore, a variety of operating modes of the driver's cab configuration 12 are available among which a train driver may switch, preferably manually. In a manual operating mode, the operating actuator 24 is inactive in a way in which it does not perform any adjustments of the control lever 18 (particularly due to the opened safety coupling 80). The control lever 18 is then merely manually shifted which is detected by the operation detection means 20 and is the basis of a control of the traction motor 14 by the drive control device 22.

In a partially autonomous operating mode, the lever 18 is controllable and, more precisely, movable by the operating actuator 24 based on the target driving behaviour defined by the target driving behaviour profile (particularly due to the closed safety coupling 80). An operator will thereby receive direct visual feedback about which driving behaviour is currently set in the form of the current position or movement of the lever 18. If he/she wishes a deviation therefrom he/she can intuitively displace the lever 18 in an appropriate manner, the position adjusted by means of the actuator constituting a readily understandable reference. When an associated adjustment was performed, the actuator 24 can then, in the absence of a manual operation and, e.g., informed of a position of the lever 18 currently detected by the operation detection means 20, move the latter back into a position corresponding to the target driving behaviour.

Consequently, as a general option not limited to the embodiment, also a data-transmitting connection not shown in FIG. 1 may exist between the operation detection means 20 and the actuator control system 26.

The partially autonomous operating mode enables the desired target driving behaviour to be precisely implementable since the operation by the actuator control system 26 is controlled in a computer-aided manner. Particularly, previous manual delays in the implementation of a desired target driving behaviour only visually displayed can be avoided. At the same time, however, there is the possibility to perform the described manual intervention and particularly the override of the actuator adjustment of the control lever 18. In this way, a reliable manual possibility to intervene is provided so that no exclusively driver-autonomous operation of the rail vehicle 1 is performed. This reduces the safety requirements and approval requirements of the rail vehicle 1 correspondingly.

A preferred variant provides that, in case of a manual intervention (i.e., a manual adjustment) of the lever 18 in the partially autonomous operating mode, an automatic shift into the manual operating mode will take place, i.e., that the partially autonomous operating mode is purposefully interrupted and terminated. As shown, this may particularly be performed by opening a safety coupling 80 when a force- and/or moment threshold is reached. In this way, it can be avoided that, from the perspective of the driver, driver-autonomous interventions take place again in an unnaturally fast manner. The control of the driving behaviour may be purposefully left to driver until he/she reactivates a partially autonomous operation. A driver-independent automatic activation of the partially autonomous operating mode, on the other hand, might involve increased approval requirements.

Figure 2:
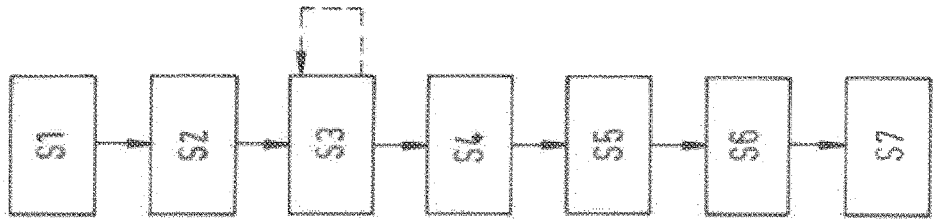
FIG. 2 shows a flow chart of the method according to FIG. 1.

In FIG. 2, a flow chart of an exemplary method is shown which is performable by the driver's cab configuration 12 according to FIG. 1 or according to which the rail vehicle 1 shown there is operable. In a step S1, a partially autonomous operating mode of the type described above is activated. In a step S2, the actuator control system 26 then receives information relating to the current location or travelled-on route segment of the rail vehicle 1 or detects this information itself. In a step S3, the actuator control system 26 then detects the target driving behaviour parameter associated with this location or route segment as predetermined and defined by the target driving behaviour profile stored in the memory device 30.

Preferably, then a current position of the lever 18 is assessed. This may take place by means of the operation detection means 20 and information detected by it. If this position of the lever 18 corresponds to a desired target driving behaviour or the target driving behaviour parameter determined in the step S3 is settable thereby, first, no separate control of the operating actuator 24 may take place. Instead, a new target driving behaviour parameter may be determined, e.g. in regular intervals or upon determination/receipt of a new location or route segment, and the lever position can be reassessed (see the dashed return arrow at S3).

However, when there is a deviation, the actuator control system 26, in step S4, controls the operating actuator 24 so that it moves the lever 18 into a position corresponding to the determined target driving behaviour parameter. This movement of the lever 18 is in turn detected by the control means 20 in step S5. The control means 20 transmits the determined operation and particularly a currently assumed position of the lever 18 to the drive control device 22 in step S6. In step S7, it will then control the traction motor 14 to implement the target driving behaviour set by the lever 18 in accordance with the assumed position (in the example shown a target driving speed).

As pointed out, this operating mode can be terminated as soon as the driver opens the safety coupling 80 by applying a manual force and then operates the lever 18 in an exclusively manual way. In addition or as an alternative, a shift to a manual operating mode may also take place by opening the safety coupling 80 by operating an operating element in the driver's console 15 (not shown).

The invention claimed is:

1. A driver's cab configuration for a rail vehicle comprising:

a driving settings device operable by a vehicle driver for setting a desired driving behavior of the rail vehicle;

a memory device in which a target driving behavior profile for the rail vehicle is stored;

an operating actuator which is configured to operate the driving settings device based on the target driving behavior profile; and a drive control device which is configured to control at least a drive device of the rail vehicle based on operations of the driving settings device, wherein the driver's cab configuration is operable in a manual operating mode in which the operating actuator does not perform operations of the driving settings device;

and is operable in at least a partially autonomous operating mode in which the driving settings device is operable by the operating actuator.

2. The driver's cab configuration according to claim 1, wherein the drive control device is designed to control the drive device irrespective of whether the driving settings device is operated by the vehicle driver or by the operating actuator.

3. The driver's cab configuration according to claim 1, wherein:

an operation detection means which is designed to detect operations and/or states of the driving settings device so that these are transmittable to the drive control device.

4. The driver's cab configuration according to claim 1, wherein operation of the driving settings device comprises adjusting and particularly tilting, shifting, and/or rotating the driving settings device.

5. The driver's cab configuration according to claim 1, wherein the operating actuator is connected to the driving settings device via a safety coupling.

6. The driver's cab configuration according to claim 5, wherein the safety coupling is openable as a result of the application of manual forces to the driving settings device; and/or in that a closure of the safety coupling is manually activatable.

7. The driver's cab configuration according to claim 1, wherein the target driving behavior profile defines a location-dependent target driving behavior, particularly a location-dependent target driving speed.

8. The driver's cab configuration according to claim 1, wherein the operating actuator is designed to operate the driving settings device so that it assumes a position in which a driving behavior corresponding to the target driving behavior profile is instructable.

9. A method for operating a rail vehicle, the rail vehicle comprising a driving settings device operable by a vehicle driver for setting a desired driving behavior, the method comprising:

an actuator operation of the driving settings device based on a target driving behavior profile; and controlling at least a drive device of the rail vehicle based on the operation of the driving settings device, wherein the drive device is operable in a manual operating mode in which the actuator does not perform operations of the driving settings device;

and is operable in at least a partially autonomous operating mode in which the driving settings device is operable by the actuator.

* * * * *